US007475491B2

(12) United States Patent
Richardson

(10) Patent No.: US 7,475,491 B2
(45) Date of Patent: Jan. 13, 2009

(54) METHOD AND APPARATUS FOR COILING ELONGATED ARTICLES

(76) Inventor: Ron Richardson, c/o 300, 1324 17th Ave SW., Calgary, Alberta (CA) T2T 5S8

( * ) Notice: Subject to any disclaimer, the term of this patent is extended or adjusted under 35 U.S.C. 154(b) by 159 days.

(21) Appl. No.: 11/380,053

(22) Filed: Apr. 25, 2006

(65) Prior Publication Data

US 2007/0245585 A1 Oct. 25, 2007

(51) Int. Cl.
*G01B 3/10* (2006.01)

(52) U.S. Cl. ..... 33/756; 33/494; 33/758

(58) Field of Classification Search ..... 33/756, 33/494, 758

See application file for complete search history.

(56) References Cited

U.S. PATENT DOCUMENTS 1,079,457 A * 11/1913 Wesson ..... 33/494
1,982,304 A * 11/1934 Holden ..... 33/756
2,089,209 A * 8/1937 Gotham et al. ..... 33/771
2,602,233 A * 7/1952 Irving ..... 33/756
4,149,320 A * 4/1979 Troyer et al. ..... 33/758
4,152,836 A * 5/1979 Rodrique ..... 33/494
4,301,596 A * 11/1981 Sedlock ..... 33/494
4,367,590 A * 1/1983 Winter et al. ..... 33/758
5,012,590 A * 5/1991 Wagner et al. ..... 33/759
5,056,234 A * 10/1991 Han ..... 33/494
5,452,523 A * 9/1995 Jansen ..... 33/555.4
5,913,586 A * 6/1999 Marshall ..... 33/759
5,950,321 A * 9/1999 Pena et al. ..... 33/758

* cited by examiner

*Primary Examiner*—Christopher W Fulton
(74) *Attorney, Agent, or Firm*—Maxey Law Offices, PLLC; Stephen Lewellyn

(57) ABSTRACT

A method and apparatus includes the coiling of an elongated article into a number of equal circumference coils through the provision of indicators spaced along a length of the article. Aligning the indicators of one set of indicators, a person can coil the elongated article into a first number of equal circumference coils and aligning the indicators of another set of indicators, a person can coil the elongated article into a second number of equal circumference coils. The first and second number of coils not being equal, i.e. the first number of coils may be four total coils and the second number of coils may be two total coils. The circumferences of the second number of coils being greater than the circumferences of the first number of coils, thereby allowing a person to choose how small or how large of a circumference of coil to create.

25 Claims, 5 Drawing Sheets

METHOD AND APPARATUS FOR COILING ELONGATED ARTICLES

FIELD OF THE INVENTION

The present invention relates generally to the coiling of elongated articles, such as cords, ropes, tubes, straps, electrical cords, and the like. More particularly, relating to a method and apparatus for coiling an elongated article into a number of generally equal circumference coils.

SUMMARY OF THE INVENTION

In accordance with the present invention, a method and apparatus for coiling an elongated article into a number of generally equal circumference coils is provided. The method includes the coiling of an elongated article into a number of generally equal circumference coils through the provision of indicators spaced along a length of the article. There are at least two sets of indicators each having markings or coloring common to one another and unique to all of the other sets of indicators. Aligning the indicators of one set of indicators, a person can coil the elongated article into a first number of generally equal circumference coils and aligning the indicators of another set of indicators, a person can coil the elongated article into a second number of generally equal circumference coils. The first and second number of circumference coils not being equal, i.e. the first number of coils may be four total coils of and the second number of coils may be two total coils. The general circumferences of the second number of coils being greater than the general circumferences of the first number of coils, thereby allowing a person to choose how small or how large of a circumference of coil to create.

In general, in one aspect, a method of coiling an elongated article into a number of generally equal circumference coils is provided. The method includes the steps of:

providing an article of a length, the article having at least two sets of indicators, wherein a first set of the at least two sets of indicators includes a plurality of individual indicators, each being common to each other and unique from all indicators not part of the first set of indicators, and being generally equally spaced apart a first distance along the length of the article, and wherein a second set of the at least two sets of indicators includes a plurality of individual indicators, each being common to each other an unique from all indicators not part of the second set of indicators, and being generally equally spaced apart a second distance along the length of the article, the first distance being greater than the second distance; and coiling the article into a number of coils of generally equal circumferences by either aligning each indicator of the plurality of individual indicators of the first set of indicators to one another or aligning each indicator of the plurality of individual indicators of the second set of indicators to one another.

In general, in another aspect, a method of coiling an elongated article into a number of generally equal circumference coils is provided. The method includes the steps of:

providing an article of a length, the article having at least two sets of indicators, wherein a first set of the at least two sets of indicators includes a plurality of individual indicators, each being common to each other and unique from all indicators not part of the first set of indicators, and being generally equally spaced apart a first distance along the length of the article, and wherein a second set of the at least two sets of indicators includes a plurality of individual indicators, each being common to each other an unique from all indicators not part of the second set of indicators, and being generally equally spaced apart a second distance along the length of the article, the first distance being greater than the second distance, the article further having a pair of start-end indicators being common to each other and unique from all of the other indicators, one indicator of said pair of start-end indicators being positioned about the article approximate a first end thereof, and the other indicator of the pair of start-end indicators being positioned about and approximate a second end of the article; and wherein the article is coiled into a number of coils of generally equal circumference by either aligning each indicator of the plurality of individual indicators of the first set of indicators to one another and the pair of start-end indicators or aligning each indicator of the plurality of individual indicators of the second set of indicators to one another and the pair of start-end indicators.

In general, in another aspect, a method of coiling an elongated article into a number of generally equal circumference coils is provided. The method includes the steps of:

a providing at least two sets of indicators, wherein each set of the at least two sets of indicators includes a plurality of individual indicators that are common to each other and unique from all other indicators not part of its set;

attaching each indicator of the plurality of indicators of a one set of the at least two sets of indicators at generally equally spaced distances of a first distance along a length of an elongated article;

attaching each indicator of the plurality of indicators of the other set of the at least two sets of indicators at generally equally spaced distances of a second distance along the same length of the article, the first distance being greater than the second distance; and coiling the article into a number of generally equal circumference coils by either aligning each indicator of the plurality of indicators of one set of the at least two sets of indicators to one another or aligning each indicator of the plurality of indicators of the other set of the at least two sets of indictors to one another.

In general, in another aspect, a method of coiling an elongated article into a number of generally equal circumference coils is provided. The method includes the steps of:

a providing at least two sets of indicators, wherein each set of the at least two sets of indicators includes a plurality of individual indicators that are common to each other and unique from all other indicators not part of its set;

attaching each indicator of the plurality of indicators of a one set of the at least two sets of indicators at generally equally spaced distances of a first distance along a length of an elongated article;

attaching each indicator of the plurality of indicators of the other set of the at least two sets of indicators at generally equally spaced distances of a second distance along the same length of the article, the first distance being greater than the second distance;

providing a pair of start-end indicators each being common to one another and unique from all other indicators;

attaching one indicator of said pair of start-end indicators about and approximate one end of the article and attaching the other indicator of said pair of start-end indicators about and approximate a second end of the article; and coiling the article into a number of coils of generally equal circumference by either aligning each indicator of said plurality of individual indicators of said first set of indicators to one another and said pair of start-end indicators or aligning each indicator of said plurality of individual indicators of said second set of indicators to one another and said pair of start-end indicators.

In general, in another aspect, an elongated article that can be coiled into a number of coils is provided. The article includes a body of a length and a least two sets of indicators, wherein a first set of the at least two sets of indicators includes a plurality of individual indicators, each being common to each other and unique from all indicators not part of the first set of indicators, and being generally equally spaced apart a first distance along the length of the body, and wherein a second set of the at least two sets of indicators includes a plurality of individual indicators, each being common to each other an unique from all indicators not part of the second set of indicators, and being generally equally spaced apart a second distance along the length of the body, the first distance being greater than the second distance.

In general, in another aspect, an elongated article that can be coiled into a number of coils is provided. The article includes a body of a length; a least two sets of indicators, wherein a first set of the at least two sets of indicators includes a plurality of individual indicators, each being common to each other and unique from all indicators not part of the first set of indicators, and being generally equally spaced apart a first distance along the length of the body, and wherein a second set of the at least two sets of indicators includes a plurality of individual indicators, each being common to each other an unique from all indicators not part of the second set of indicators, and being generally equally spaced apart a second distance along the length of the body, the first distance being greater than the second distance; and a pair of start-end indicators being common to each other and unique from all of the other indicators, one indicator of the pair of start-end indicators being positioned about the body approximate a first end thereof, and the other indicator of the pair of start-end indicators being positioned about and approximate a second end of the body.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
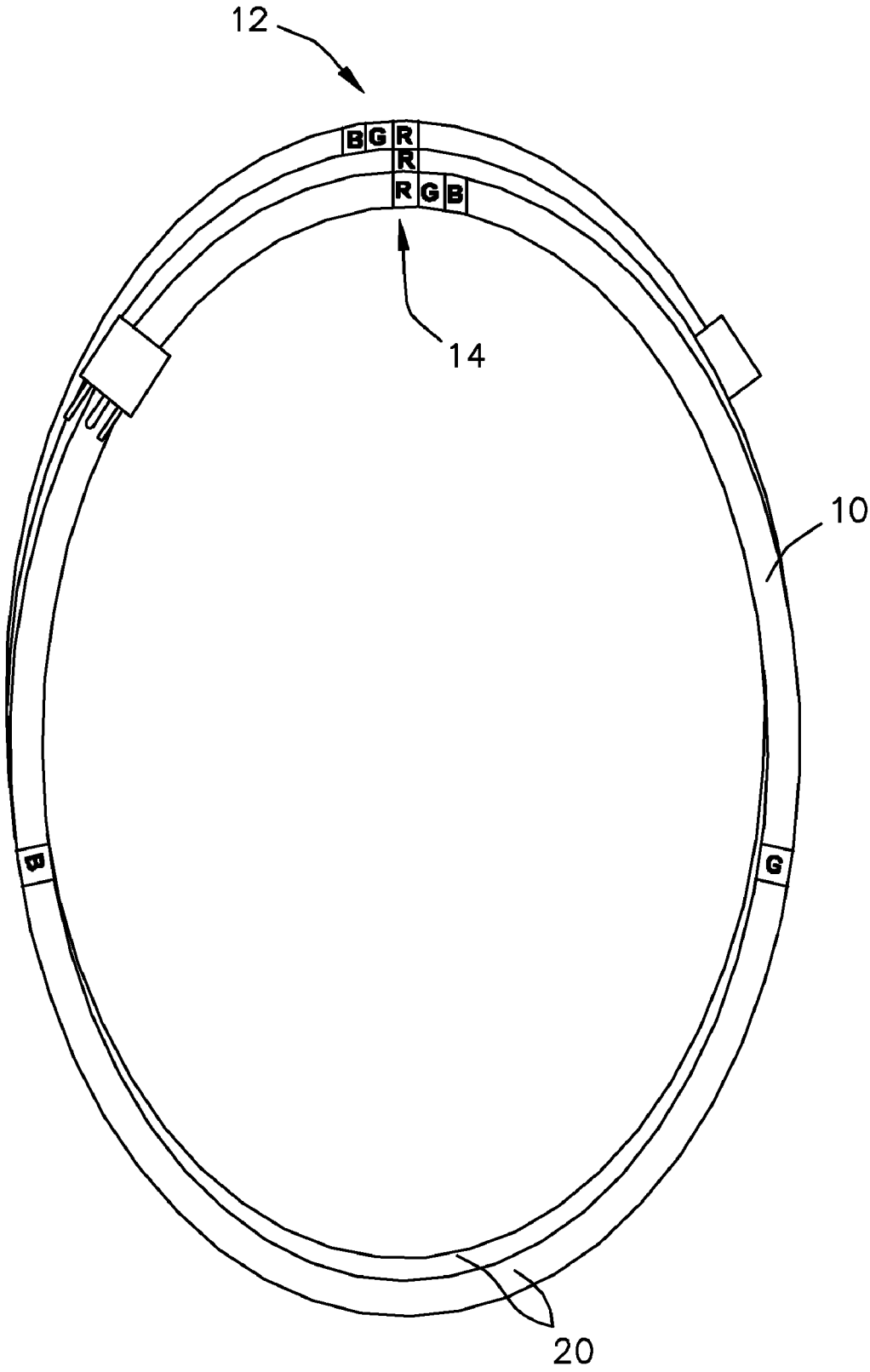
FIG. 1 is a perspective view of an elongated article having a plurality of sets of indicators spaced along a length of the article and illustrating the article coiled into a number of equal circumference coils in accordance with the principles of the present invention.

With reference to FIG. 1, an elongated article 10, such as an electrical extension cord, is shown coiled into a number of coils of generally equal circumferences in accordance with the methods of the present invention. While an electrical extension cord is shown by way of example, the elongated article 10 may be of any article having a length that is greater than its width or circumference, and can include but is not limited to an electrical extension cord, an electrical cord, a cord, a rope, a strap, a pipe, a tube or a hose.

Figure 2A:
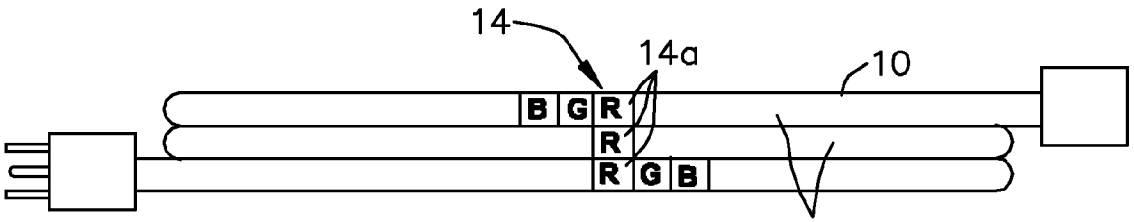
FIG. 2*a* is a plan view of the coiled elongated article of FIG. 1.
Figure 2B:
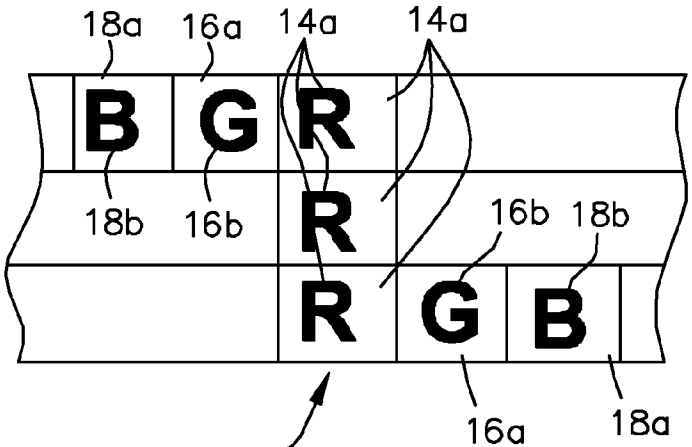
FIG. 2*b* is an enlarged detail view of a section of the elongated article of FIG. 2.

In FIGS. 1, 2*a* and 2*b* the elongated article 10 is shown coiled into two coils 20 of generally equal circumferences. As seen from these figures, there are a plurality of sets of indicators generally designated by element 12. A first set of indicators 14 having a plurality of individual indicators 14*a* is shown in alignment and a second and third set of indicators 16 and 18 having a plurality of individual indicators 16*a* and 18*a* respectively are shown not in alignment. The individual indicators 14*a*, 16*a* and 18*a* each have indicia or markings coloring 14*b*, 16*b*, and 18*b* respectively or coloring which distinguish the 14*a* indicators from the 16*a* and 18*a* indicators, the 16*a* indicators from the 14*a* and 18*a* indicators and so forth. The indicia or markings 14*b* or coloring are common or identical to each other 14*b* indicia or marking or coloring, the indicia or markings 16*b* or coloring are common or identical to each other 16*b* indicia or marking or coloring, the indicia or markings 18*b* or coloring are common or identical to each other 18*b* indicia or markings or coloring, and so forth.

While three sets of indicators 14, 16 and 18 are shown in FIGS. 1 and 2, there can be as few as at least two sets of indicators to as many sets of indicators as required or desired, and this concept carries throughout this entire disclosure.

Aligning the each indicator 14*a*, 16*a*, or 18*a* of one set of indicators 14, 16 or 18, a person can coil the elongated article 10 into a first number of generally equal circumference coils 20 and aligning the indicators of another set of indicators, a person can coil the elongated article into a second number of generally equal circumference coils 20, and so forth. The first, second or other number of circumference coils not being equal, i.e. the first number of coils may be two total coils and the second number of coils may be four total coils, and a third number of coils of may total a number of coils which is not equal to the first and second number of coils. The circumferences of the first number of coils being greater than the circumferences of the second number of coils, etc, thereby allowing a person to choose how small or how large of a circumference of coil to create.

Figure 3:
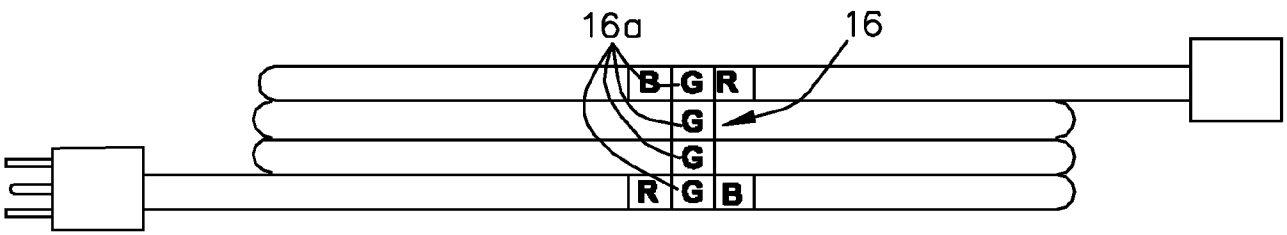
FIG. 3 is a plan view of the elongated article of FIG. 1 illustrating the article coiled into two coils of equal circumferences by aligning the indicators of a second set of indicators from that as shown in FIGS. 1 and 2.
Figure 4:
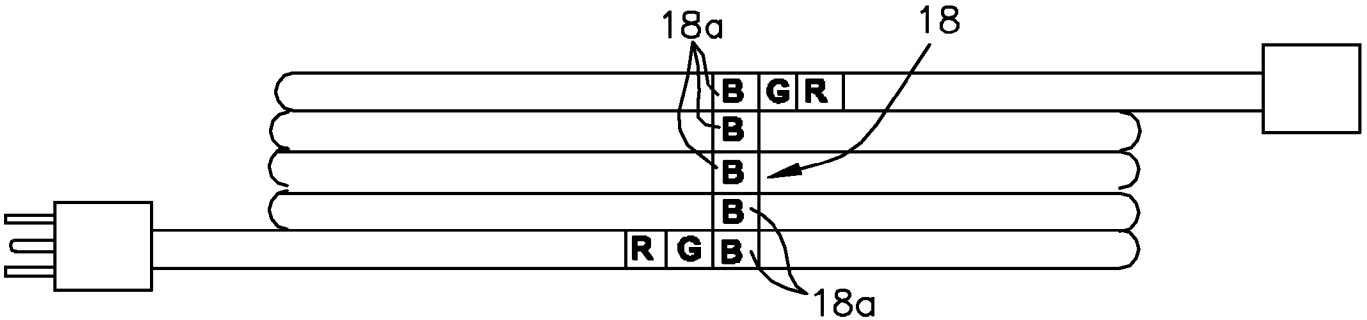
FIG. 4 is a plan view of the elongated article of FIG. 1 illustrating the article coiled into four coils of equal circumferences by aligning the indicators of a third set of indicators from that as shown in FIGS. 1, 2; and 3.

This concept is illustrated in FIGS. 3 and 4, wherein FIG. 3 the elongated article 10 is shown coiled into three coils of generally equal circumferences by aligning the individual indicators 16*a* of the second set of indicators 16 and in FIG. 4, the elongated article is shown coiled into four coils of generally equal circumferences by aligning the individual indicators 18*a* of the third set of indicators 18.

Figure 5:
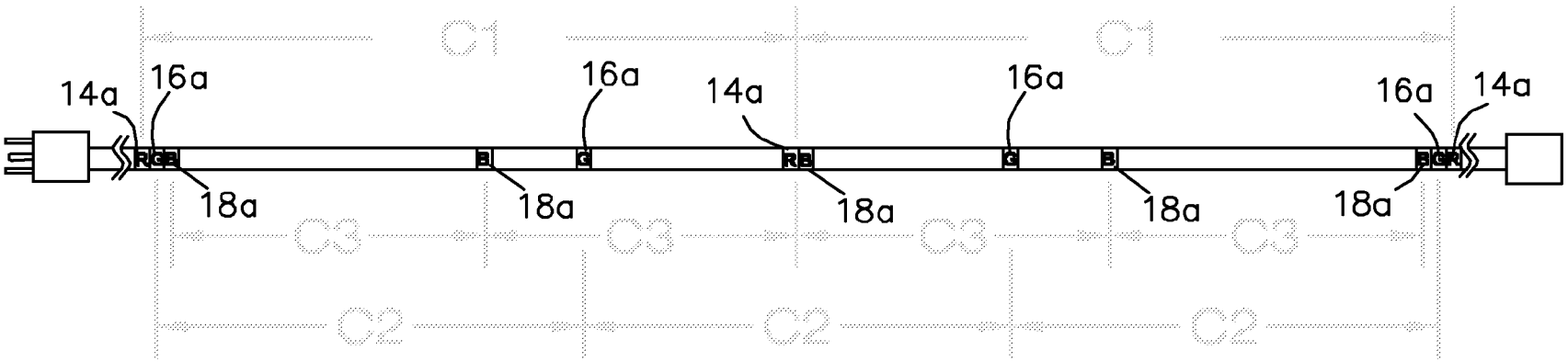
FIG. 5 is a plan view of the elongated article of FIG. 1 stretched out a length of the elongated article illustrating the spacing of different sets of indicators along a length of the article.

Now with reference to FIG. 5, a length of the elongated article 10 of FIG. 1, is shown stretched out with a plurality of indicators 14*a*, 16*a*, and 18*a* spaced along the length of the elongated article. As shown there are three indicators 14*a* spaced at generally equal distances of a first distance $C_1$ along the length of the elongated article 10, there are four indicators 16*a* spaced at generally equal distances of a second distance $C_2$ along the same length of the elongated article, and there are five indicators 18*a* spaced at generally equal distances of a third distance $C_3$ along the same length of the elongated article. The first distance $C_1$ is greater than the second distance $C_2$, and the first distance $C_1$ and the second distance $C_2$ are each greater than the third distance $C_3$.

The value of the distance $C_1$ is equal to the circumference of a coil of the elongated article 10 if coiled using the indicators 14*a* of the first set of indicators 14. Likewise the value of the distances $C_2$ and $C_3$ are equal to the circumference of a coil of the elongated article 10 if coiled using the indicators 16*a* and 18*b* respectively. There are three sets of indicators 14, 16 and 18 shown here; however, as few as two sets as many sets of indicators required or desired may be used.

Figure 6:
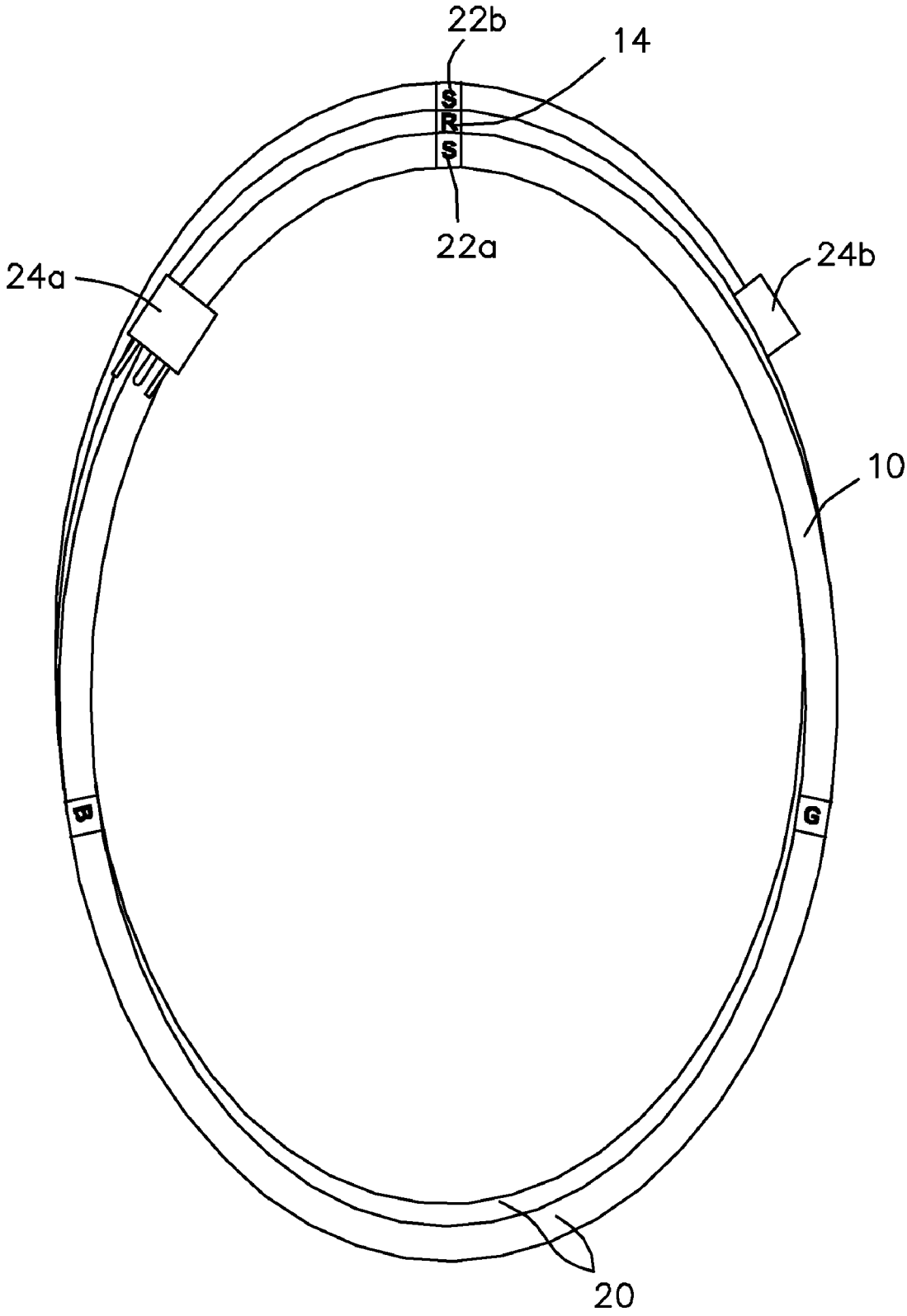
FIG. 6 is a perspective view of an elongated article coiled into two coils through the use of at least one set of indicators and a pair of start-end indicators.

With references to FIG. 6, in another embodiment, the elongated article 10 can further include a pair of start-end indicators 22*a* and 22*b* positioned approximate the ends 24*a* and 24*b* of the elongated article. The pair of start-end indicators 22*a* and 22*b* aid a user in locating and positioning the ends and of the elongated article 10. The pair of start-end indicators 22*a* and 22*b* are each aligned with either set of indicators 14, 16 or 18 to coil the elongated article into a number of coils of generally equal circumferences. The start indicator 22*a* beginning the coils and the end indicator 22*b* ending the coils. It is important to note, that while only three sets of indicators are shown used along with the pair of start-end indicators 22*a* and 22*b*, any number of sets of indicators as few as two sets as many sets of indicators required or desired may be used.

Figure 7:
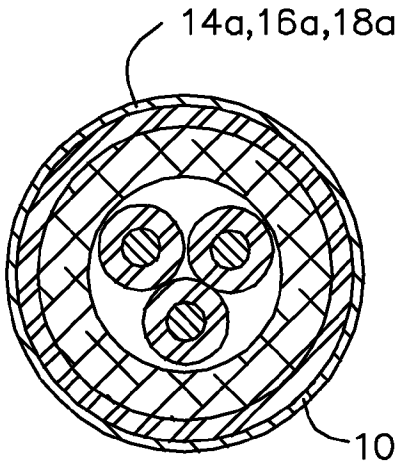
FIG. 7 is a transverse cross sectional view of the elongated article taken an indicator.

Individual indicators, such as indicators 14*a*, 16*a*, 18*a* or the start-end indicators 22*a* and 22*b* can be made integral with the elongated article 10 or can be printed, painted or spray coated onto the elongated article as shown in FIG. 7. The indicators, can be formed to completely encircle the circumference or perimeter of the elongated article 10, or formed to only partially encircle the circumference or perimeter of the elongated article 10.

Figure 8:
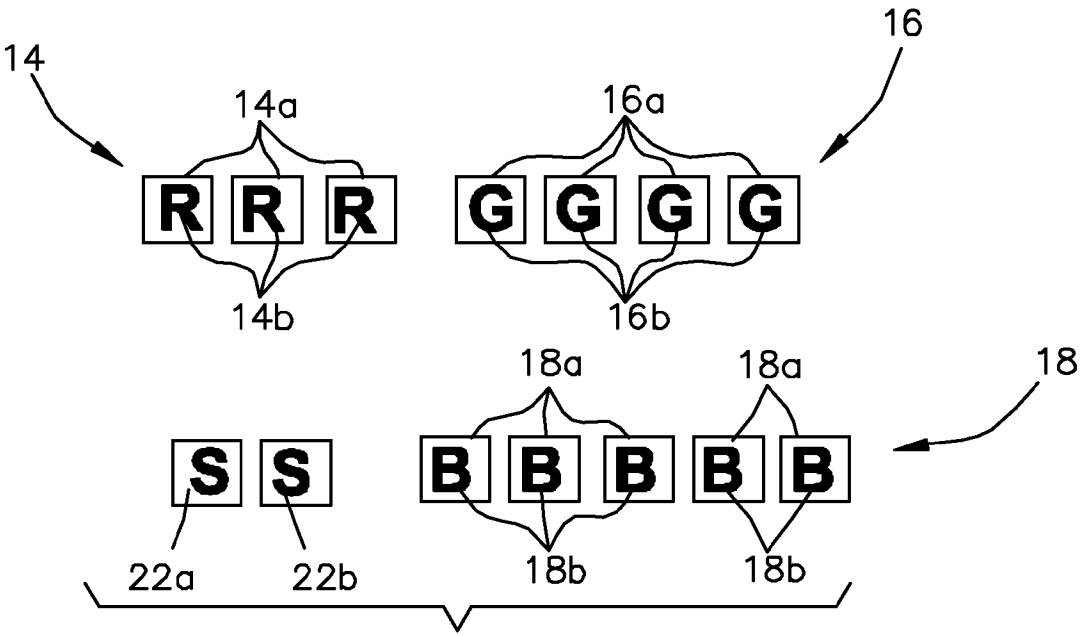
FIG. 8 is a diagrammatic view of a plurality of sets of indicators each having a plurality of individual indicators bearing markings, indicia or being of a color common to one another and unique from the other sets of indicators.
Figure 11:
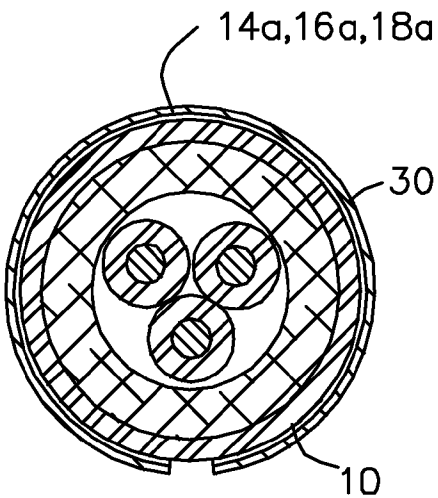
FIG. 11 is the cross sectional view of the elongated article showing an example of an indicator in the form of a label or appliqué adhesively attached to the elongated article.
Figure 10:
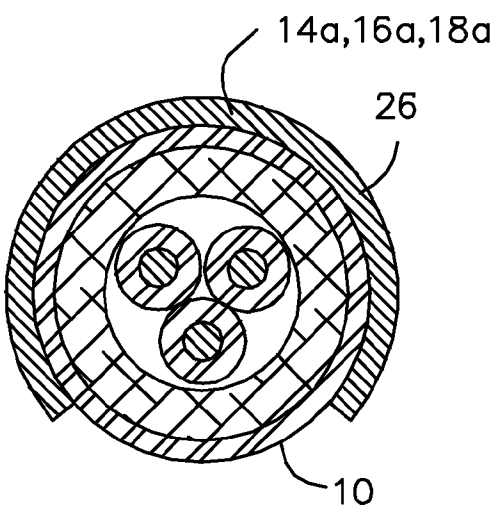
FIG. 10 is a cross sectional view of the elongated article showing an example of an indicator in the form of a clip.
Figure 9:
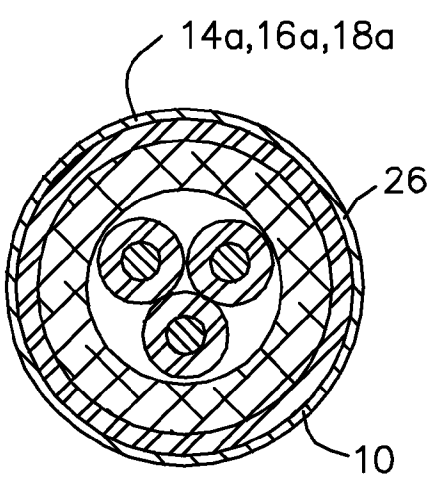
FIG. 9 is a cross sectional view of the elongated article showing an example of an indicator in the form of a heat-shrinkable tubing or band.

With reference to FIG. 8, each individual indicator 14*a*, 16*a*, and 18*a* of each set of indicators 14, 16 and 18 or the start-end indicators 22*a* and 22*b* can be provided separate of the elongated article 10 and can be attached to the elongated article during manufacture or can attached to the elongated article post manufacture, by a consumer, following provided instruction. As shown in FIG. 9, each indicator can be in the form of heat-shrinkable tubing or bands 26, which are applied along the length of the elongated article 10 and heat shrunk to adhere to the elongated article at each desired location. As shown in FIG. 10, each indicator can be in the form of a clip 28 can attached to the elongated article 10 by slipping the clip over the elongated article 10. As shown in FIG. 11, each indicator can be in the form of label 30 that can adhesively attached to the elongated article. Moreover, each set of indicators can be color coded to correspond to each other indicator within the set, or can be marked with a code or indicia to correspond to each other indicator within the set or can include a combination of coloring coding and markings or indicia.

The above only describes a fraction of the possible forms the indicators can take and attached to the elongated article 10. As such, the invention should not be limited to only the example forms as described above and should encompass any indicator attached to an elongated article for the use in aiding a person in the coiling of the elongated article into a chosen number of coils each having generally equal circumferences. In the case of a strap or the like, each coil or loop may be formed over the previous coil or loop and remain in accordance with the principals of the present invention.

In general, in one aspect, and by way of example using at least two sets of indicators, a method of coiling the elongated article 10 into a number of generally equal circumference coils 20 includes the steps of:

providing an article 10 of a length, the article having at least two sets of indicators 14 and 16, wherein a the first set 14 of the at least two sets of indicators includes a plurality of individual indicators 14*a* each common to each other and unique from all other indicators not part of the first set, each individual indicator 14*a* of the plurality of individual indicators of the first set 14 of indicators being generally equally spaced apart a first distance $C_1$ along the length of the article 10, and wherein a second set 16 of the at least two sets of indicators includes a plurality of individual indicators 16*a* each being common to each other and unique each of the plurality of individual indicators of the first set 14 of indicators, each individual indicator 16*a* of the plurality of individual indicators of the second set of indicators 16 being generally equally spaced apart a second distance $C_2$ along the length of the article 10, the first distance $C_1$ being greater than the second distance $C_2$; and coiling the article 10 into a number of coils 20 each having generally equal circumferences by aligning either each indicator 14*a* of the plurality of individual indicators of the first set 14 of indicators or each indicator 16*a* of the plurality of individual indicators of the second set 16 of indicators.

While only at least two sets of indictors where used in the above method, as few as two sets as many sets of indicators required or desired may be used. For example, the article 10 can include a third set or additional sets of indicators having a plurality of individual indicators each common to each other and unique from the each other of the plurality of individual indictors of the first and second sets of indicators, each individual indicator of the plurality of individual indicators of the third set of indicators being generally equally spaced apart a third distance along the length of the article, the first and second distances each being greater than the third distance.

In another aspect, a method of coiling the elongated article 10 into a number of generally equal circumference coils 20, the method includes the steps of:

a providing at least two sets of indicators 14 and 16, wherein each set of the at least two sets of indicators includes a plurality of individual indicators 14*a* and 16*a* bearing indicia 14*b* and 16*b* common to each other and unique to the other set of indicators of the at least two sets of indicators;

attaching each indicator 14*a* of the plurality of indicators of a one set 14 of the at least two sets of indicators at equally spaced distances of a first distance C1 along a length of an elongated article 10;

attaching each indicator 16*a* of the plurality of indicators of the other set 16 of the at least two sets of indicators at equally spaced distances of a second distance C2 along the same length of the article, the first distance C1 being greater than the second distance C2; and coiling the article 10 into a number of generally equal circumference coils 20 by either aligning each indicator 14*a* of the plurality of indicators of one set 14 of the at least two sets of indicators or aligning each indicator 16*a* of the plurality of indicators of the other set 16 of the at least two sets of indictors.

Again, while only at least two sets of indictors where used in the above method, as few as two to as many sets of indicators may be used. For example, a third set of indicators 18 or any number of additional sets could be provided. By way of example, the third set 18 has a plurality of individual indicators 18*a* being common to each other and unique to the other sets of indicators 14 and 16 of the at least two sets of indicators. The third set 18 or any number of additional sets are of indicators 18*a* are attached at equally spaced distances of a third distance $C_3$ or $C_x$ along the same length of the article, the first and second distances each being greater than the third distance.

A number of embodiments of the present invention have been described. Nevertheless, it will be understood that various modifications may be made without departing from the spirit and scope of the invention. Accordingly, other embodiments are within the scope of the following claims.

I claim:

1. A method of coiling an elongated article into a number of generally equal circumference coils, the method comprising the steps of:

providing an article of a length, said article having at least two sets of indicators, wherein a first set of said at least two sets of indicators includes a plurality of individual indicators, each being common to each other and unique from all indicators not part of said first set of indicators, and being generally equally spaced apart a first distance along the length of said article, and wherein a second set of said at least two sets of indicators includes a plurality of individual indicators, each being common to each other an unique from all indicators not part of said second set of indicators, and being generally equally spaced apart a second distance along the length of said article, said first distance being greater than said second distance; and coiling said article into a number of coils of generally equal circumferences by either aligning each indicator of said plurality of individual indicators of said first set of indicators to one another or aligning each indicator of said plurality of individual indicators of said second set of indicators to one another.

2. The method in accordance with claim 1, wherein said article includes a third set of indicators including a plurality of individual indicators each being common to each other and unique from all indicators not part of said third set of indicators and being generally equally spaced apart a third distance along the length of said article, said first and second distances each being greater than said third distance.

3. The method in accordance with claim 1, wherein each indicator of said first set of indicators is color coded to corresponded with one another and to be unique from all other indicators, and wherein each indicator of said second set of indicators is color coded to correspond with one another and to be unique from all other indicators.

4. The method in accordance with claim 1, wherein each indicator of said first set of indicators bear indicia common with one another and unique from all other indicators, and wherein each indicator of said second set of indicators bear indicia common with one another and to be unique from all other indicators.

5. The method in accordance with claim 1, wherein each indicator of said first and second sets of indicators completely encircle said article at its respective position along said article.

6. The method in accordance with claim 1, wherein said article further includes:

a pair of start-end indicators being common to each other and unique from all of the other indicators, one indicator of said pair of start-end indicators being positioned about said article approximate a first end thereof, and the other indicator of said pair of start-end indicators being positioned about and approximate a second end of said article; and wherein said article is coiled into a number of coils of generally equal circumference by either aligning each indicator of said plurality of individual indicators of said first set of indicators to one another and said pair of start-end indicators or aligning each indicator of said plurality of individual indicators of said second set of indicators to one another and said pair of start-end indicators.

7. The method in accordance with claim 6, wherein each indicator of said first set of indicators is color coded to corresponded with one another and to be unique from all other indicators, and wherein each indicator of said second set of indicators is color coded to correspond with on another and to be unique from all other indicators.

8. The method in accordance with claim 6, wherein each indicator of said first set of indicators bear indicia common with one another and unique from all other indicators, and wherein each indicator of said second set of indicators bear indicia common with one another and to be unique from all other indicators.

9. The method in accordance with claim 6, wherein each indicator of said first and second sets of indicators completely encircle said article at its respective position along said article.

10. A method of coiling an elongated article into a number of generally equal circumference coils, the method comprising the steps of:

a providing at least two sets of indicators, wherein each set of said at least two sets of indicators includes a plurality of individual indicators that are common to each other and unique from all other indicators not part of its set;

attaching each indicator of said plurality of indicators of a one set of said at least two sets of indicators at generally equally spaced distances of a first distance along a length of an elongated article;

attaching each indicator of said plurality of indicators of the other set of said at least two sets of indicators at generally equally spaced distances of a second distance along the same length of the article, said first distance being greater than said second distance; and coiling the article into a number of generally equal circumference coils by either aligning each indicator of said plurality of indicators of one set of said at least two sets of indicators to one another or aligning each indicator of said plurality of indicators of the other set of said at least two sets of indictors to one another.

11. The method in accordance with claim 10, further comprising the steps of:

providing a third set of indicators including a plurality of individual indicators that are common to each other and unique from all other indicators not part of said third set of indicators; and attaching each indicator of said plurality of indicators of said third set of indicators at generally equally spaced distances of a third distance along the same length of the article, said first and second distances each being greater than said third distance.

12. The method in accordance with claim 10, wherein each indicator is color coded to corresponded to each other indicator of the same set and to be unique from all other indicators.

13. The method in accordance with claim 10, wherein each indicator bears indicia common with each another indicator of the sane set and to be unique from all other indicators.

14. The method in accordance with claim 10, wherein each indicator completely encircle the article at its respective position along the article.

15. The method in accordance with claim 10, further comprising the step of:

providing a pair of start-end indicators each being common to one another and unique from all other indicators;

attaching one indicator of said pair of start-end indicators about and approximate one end of the article and attaching the other indicator of said pair of start-end indicators about and approximate a second end of the article; and wherein the article is coiled into a number of coils of generally equal circumference by either aligning each indicator of said plurality of individual indicators of said first set of indicators to one another and said pair of start-end indicators or aligning each indicator of said plurality of individual indicators of said second set of indicators to one another and said pair of start-end indicators.

16. The method in accordance with claim 15, wherein each indicator is color coded to corresponded each other indicator of the same set and to be unique from all other indicators.

17. The method in accordance with claim 15, wherein each indicator bears indicia common with each another indicator of the same set and unique from all other indicators.

18. The method in accordance with claim 15, wherein each indicator completely encircle the article at its respective position along the article.

19. The method in accordance with claim 10, wherein the article is an electrical cord.

20. An elongated article that can be coiled into a number of coils, the elongated article comprising:

a body of a length;

a least two sets of indicators, wherein a first set of said at least two sets of indicators includes a plurality of individual indicators, each being common to each other and unique from all indicators not part of said first set of indicators, and being equally spaced apart a first distance along the length of said body, and wherein a second set of said at least two sets of indicators includes a plurality of individual indicators, each being common to each other and unique from all indicators not part of said second set of indicators, and being equally spaced apart a second distance along the length of said body, said first distance being greater than said second distance; and a pair of start-end indicators being common to each other and unique from all of the other indicators, one indicator of said pair of start-end indicators being positioned about said body approximate a first end thereof, and the other indicator of said pair of start-end indicators being positioned about and approximate a second end of said body.

21. The elongated article of claim 20, further comprising:

a third set of indicators including a plurality of individual indicators each being common to each other and unique from all indicators not part of said third set of indicators and being generally equally spaced apart a third distance along the length of said body, said first and second distances each being greater than said third distance.

22. The elongated article of claim 20, wherein each indicator is color coded to corresponded each other indicator of the same set and to be unique from all other indicators.

23. The elongated article of claim 20, wherein each indicator bears indicia common with each another indicator of the sane set and unique from all other indicators.

24. The elongated article of claim 20, wherein each indicator completely encircle the article at its respective position along the article.

25. The elongated article of claim 20, wherein said body being selectively coilable in to at least two different circumferences by aligning said indicators of either set of indicators.

* * * * *